US005901412A

United States Patent [19]

Jentsch

[11] Patent Number: 5,901,412

[45] Date of Patent: May 11, 1999

[54] TOP-MOUNTED DOOR CLOSER

[75] Inventor: Dietrich Jentsch, Ennepetal, Germany

[73] Assignee: Dorma GmbH + Co. KG, Ennepetal, Germany

[21] Appl. No.: 08/938,223

[22] Filed: Sep. 26, 1997

Related U.S. Application Data

[63] Continuation-in-part of application No. PCT/DE97/00122, Jan. 24, 1997.

[30] Foreign Application Priority Data

Jan. 30, 1996 [DE] Germany ..... 196 03 186

[51] Int. Cl.[6] ..... E05F 1/08; E05F 3/20

[52] U.S. Cl. ..... 16/72; 16/53; 16/60

[58] Field of Search ..... 16/72, 71, 53, 16/60, 61, 62, 82, 51, 52, 57–59, DIG. 10

[56] References Cited

U.S. PATENT DOCUMENTS 4,785,493 11/1988 Tillmann et al. ..... 16/53
5,417,013 5/1995 Tillmann ..... 16/53
5,535,514 7/1996 Lucas ..... 16/62

FOREIGN PATENT DOCUMENTS 3411189 10/1985 Germany .
4038720 6/1992 Germany .
4041824 6/1992 Germany .
9413039 6/1995 Germany .

*Primary Examiner*—Chuck Y. Mah
*Attorney, Agent, or Firm*—Nils H. Ljungman & Associates

[57] ABSTRACT

A door closer actuated by an eccentric cam plate includes a one-piece piston that is displaced axially by the rotation of the eccentric cam plate. The one-piece piston includes a damping piston portion located axially on one side of the eccentric cam plate and a spring support element located on the opposite side of the eccentric cam plate. The one-piece piston incorporates in a unitary piece both functions of a separate damping piston and spring support element to increase the relative efficiency of the door closer.

20 Claims, 4 Drawing Sheets

TOP-MOUNTED DOOR CLOSER

This application is a CIP of PCT/DE97/00122, filed Jan. 24, 1997.

BACKGROUND OF THE INVENTION

1. Field of the Invention

The present invention relates generally to a door closer, preferably a top-mounted or overhead door closer. The door closer can include a closer shaft, which closer shaft can be actuated by a spring system in the closing direction. The door closer can also include a damping piston. The damping piston can, in effect, be connected to the closer shaft. An end of the closer shaft can extend out of the door closer housing. The end of the closer shaft can be coupled and connected to an actuator arm. The actuator arm can preferably be formed as a slide rail linkage. The slide rail linkage can be engaged in a guide rail by use of a slide. The slide can be located at the other end of the actuator arm. The closer shaft can include an eccentric cam plate. The cam profile of the eccentric cam plate corresponding to the opening direction can be pressurized by a spring assist element by use of at least one roller, and the cam profile of the eccentric cam plate corresponding to the closing direction can be pressurized by a damping piston by use of an additional roller. The roller of the damping piston and the roller of the spring assist element can be oriented substantially coaxially with the closer shaft.

In the door closer realized in accordance with the present invention, the damping piston and the spring assist element can preferably be manufactured as a single part. Placed inside a recess, between two rollers, there can be the eccentric cam plate. The eccentric cam plate can be mounted inside the door closer, and the projecting closer shaft can be connected to one end of the actuator arm. The other end of the actuator arm can interact with the sliding block of the slide rail.

2. Background Information

A known top-mounted door closer with a slide rail linkage is described in German Patent No. 40 38 720 C2, assigned to the assignee of the present invention. This sliding rail door closer is suitable for all types of installation, i.e. right or left stop on the strip or band side or on the side opposite the strip, both in a normal installation on the door panel and in an overhead installation on the door frame. An eccentric cam plate is used, the two eccentric cam plates of which are symmetrically constructed. As a result of the symmetrical cam profiles, the same torque curve is achieved in both directions of rotation. The eccentric cam plate is thereby fastened to a closer shaft. The closer shaft is mounted on one end in the lower portion of the housing, and is held in the other direction by an end-cap which is provided with a bearing. On one side, the eccentric cam plate thereby comes into contact with a roller which is inserted in the damping piston and on the other side with a roller which is inserted in the spring assist element. The damping piston and the spring assist element can execute movements independently of one another. For that purpose, pressure is applied to the damping piston by a compression spring and pressure is applied to the spring assist element by the compression spring of the spring actuator so that the two above-mentioned rollers come into contact on the inside against the eccentric cam disc. Inside the damping piston there is a non-return and pressure relief valve.

An additional door closer is described in German Patent No. 40 41 824 C1, also assigned to the assignee of the present invention, in which there are also a separate damping piston and a separate spring assist element. Each of the damping piston and the spring assist element is equipped with a roller. The damping piston and the spring assist element are located to the left and right in a housing so that the eccentric cam plate which is located on a shaft between them is engaged with these rollers. Pressure is applied to both the damping piston and the spring assist element by a compression spring toward the spring assist element. There are securing means to prevent a rotation of the spring assist element with respect to the damping piston. The function of the door closer is not in the least adversely affected by the presence of securing means in the form of pins, because even then, the damping piston and the spring assist element can operate completely separately from one another. The securing means can thereby be anchored, for example, on one end in the spring assist element and on the other end can be inserted without friction in blind holes on the opposite side inside the damping piston. The securing rods thereby run horizontally in relation to the vertical axis of the door closer shaft. If the damping piston and the spring assist element have a tendency to rotate with respect to one another, this rotation can be securely prevented by the securing means, because the rotational movement is prevented by the contact against the eccentric cam plate.

OBJECT OF THE INVENTION

The object of the present invention is to reduce the manufacturing costs of a top-mounted door closer, while simultaneously increasing the efficiency of the door closer.

SUMMARY OF THE INVENTION

The present invention teaches that this object can be achieved by a door closer which preferably includes a one-piece piston. The one-piece piston preferably used can combine the functions of both the damping piston and the spring assist element. The piston can thereby be preferably realized in the form of a relatively long, stretched-out round component which, approximately in its central area, can have a recess. The recess can extend beyond the axial central area for the installation of the eccentric cam plate. Adjacent to the recess there can be an opening, which opening can act on one hand as a passage for the closer shaft, but at the same time can give the overall piston the ability to move axially as a result of the rotational movement of the closer shaft.

The selection of a longer piston can result in improved guidance and support in the cylinder boring. Consequently, the transverse forces, which transverse forces in essence always occur, can be reduced. This reduction in transverse forces can be accompanied by an essentially simultaneous reduction of friction, thereby improving efficiency.

The part of the piston which performs the function of a damping piston can be realized so that the outer surface of the piston can be guided by the cylinder wall in the surrounding housing, the guiding preferably being accomplished without a seal or gasket. As a result of the use of a one-piece piston, it can thereby be possible to omit the second compression spring, which second compression spring is required in the known door closers as described above. In the axial direction, the area which serves as the damping piston can have a boring or bore, which boring can hold a non-return and pressure relief valve. Adjacent to this axial boring there can be an axial recess to or toward the center of the piston which holds a starting or start-up or approach roller.

This starting roller can be rotationally retained by use of a pin, which pin can be inserted radially into the damping piston preferably in a blind hole or a stepped or graduated boring. The pin, on the side facing the wall of the cylinder, can thereby preferably have a protective plastic cap, so that if this pin should unintentionally become detached, it essentially will not leave any chatter marks in the vicinity of the cylinder walls.

The portion of the piston which is realized so that it functions as the spring assist element can have substantially the same diameter as the part which is realized as the damping piston. Inside the spring assist element, however, there can be a boring or bore into which boring an inner part can be inserted. The inner part can preferably be displaced or be displaceable in the axial direction. On the outside, this inner part can have an extension. The extension can be used for mounting and thus can be used for the relatively secure placement of the compression spring for the energy storage device. The inner part preferably has a boring which runs essentially in the axial direction, to allow the damping medium to flow out of the spring chamber into the compression chamber. Also on this side of the piston, and also in the axial direction, there can be a recess which is also used to hold a force transmission roller. This force transmission roller can be mounted by the use preferably of a needle bearing on a pin. The pin can run through the outer walls of the spring assist element with a certain amount of clearance, and the pin can be simultaneously positively and non-positively connected with the inner part, inside the inner part, by use preferably of an interference fit. In its end pointing toward the vicinity of the cylinder wall, this pin in turn can have an end-cap, which end-cap can preferably be made of plastic.

Because the dimensions of the inner part can be coordinated with the dimensions of the internal boring of the spring assist element so that the inner part can move in the axial direction, it is possible, within a certain range, namely the size of the clearance between the radially inserted pin, for the force transmission roller to displace the inner part in the axial direction. This measure can essentially always guarantee that, on one hand, both the starting and the force transmission rollers are in relatively secure contact with the eccentric cam plate in essentially all areas during a rotation of the eccentric cam plate, and on the other hand, essentially simultaneously guarantees that the transmission of forces takes place via the rollers, which rollers are preferably located in the axial center of the piston, and not through the outside surfaces of the piston. The result can be an improvement in efficiency. The improvement in efficiency can result from the fact that the piston essentially does not have a tendency to tip as a result of the other forces being applied, e.g. by the compression spring. Tipping can be substantially prevented by the one-piece construction of the damping piston and the spring assist element, which damping piston and spring assist element essentially cannot under any circumstances become separated. Those forces inside the door closer, which forces can result in a drifting or excursion of the individual pistons which are present in known similar devices, essentially cannot occur here because there is a relatively ideal transmission of forces in the axial center line, i.e. via the force transmission roller, the eccentric cam plate and the adjacent starting roller. The loads are therefore removed from the outside surfaces of both the damping piston and the spring assist element, which simultaneously means that as a result of the substantial absence of tipping of the individual pistons, the level of wear can be reduced, and thus there can be an increase in the efficiency of such a top-mounted door closer, although as in the known devices, with the one-piece piston under load, both the roller of the damping piston and the roller of the inner part of the spring assist element can be in contact with the cam profiles of the eccentric cam plate.

Additional features can also be used to further improve efficiency, namely, for a possible embodiment of the present invention, a safety plate. The safety plate can substantially prevent or limit a rotation of the entire piston and thus also a tipping with respect to the eccentric cam plate. This protection can also be provided by preferably inserting a safety plate under or over the starting roller and the force transmission roller. In the central area of the safety plate there can be an opening, which opening can allow the end of the closer shaft mounted inside the housing to pass through. The opening can also allow sufficient freedom of movement in the axial direction so that the piston can move in the axial direction. Essentially at the same time, a rotation of the piston with respect to the eccentric cam plate can be prevented by the presence of the safety plate either above or below the eccentric cam plate. If the piston should have a tendency to rotate with respect to the eccentric cam plate, this rotational movement can be prevented because the safety plate can preferably come into contact with the eccentric cam plate.

As a result of the one-piece configuration of the piston, the present invention can have an advantage over known door closers, in that a door closer made in accordance with the present invention can essentially always have two pistons moving in opposite directions. This can permit the present invention to achieve a relatively enormous increase in efficiency in comparison to the known door closers.

In other words, for a possible embodiment of the present invention, the one-piece piston can include two piston portions. Each piston portion can define a portion of a chamber adjacent the corresponding piston portion, which chamber portions can contain damping medium. During operation of the door closer, the movement of the one-piece piston can cause one piston portion to reduce the volume of its adjacent chamber portion and the other piston portion to expand the volume of its adjacent chamber portion. Through the use preferably of connecting flow passages and valving permitting fluid communication between the two chambers, the desired damping characteristics during door closer operation can be achieved.

It can also be possible to reduce the manufacturing costs on one hand, because of the elimination of the second compression spring, and the assembly costs on the other hand. To achieve these objectives, the entire piston can be pre-assembled outside the housing, for example. The piston can then be inserted into the cylinder wall of the housing as a complete assembly, in which case the eccentric cam plate can be inserted from above between the starting roller and the force transmission roller which have a defined seat. Then the end-cap for the extended closer shaft can be installed, and the compression spring can be introduced into the housing, and the housing can be closed on both ends.

As a result of the relatively economical construction claimed by the present invention, automatic assembly can also be possible, essentially without any reduction in the relative quality or the relative efficiency of such a top-mounted door closer.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to one possible embodiment which is illustrated schematically in the accompanying drawings, in which.

DESCRIPTION OF THE PREFERRED EMBODIMENT

Figure 1:
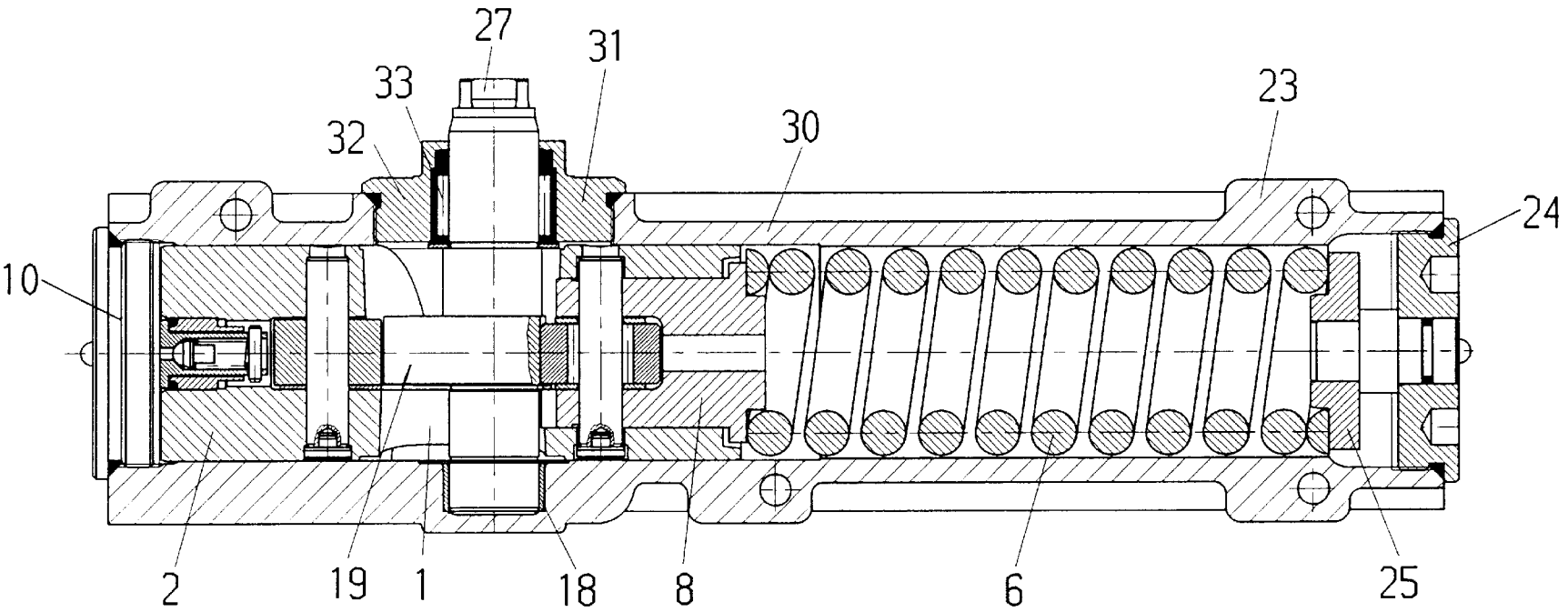
FIG. 1 shows a top-mounted door closer in a sectional view, with the piston inserted.

FIG. 1 shows a housing 23 of a possible embodiment of a top-mounted door closer made in accordance with the present invention, in which door closer one end 27 of a closer shaft 33 can be connected by an end-cap 31 with the housing 23. Inside the end-cap 31 there can be a bearing 32 for the rotational mounting of the closer shaft 33. The other end of the closer shaft 33 can be rotationally mounted inside the housing 23 in an inside bearing 18. Between the two bearings 18, 32, preferably at or near the axial center of the door closer, there can be an eccentric cam plate 19, which eccentric cam plate 19 can be positively and non-positively connected to the closer shaft 33. The closer shaft 33 thereby can run with the eccentric cam plate 19 through a piston 1. The piston 1 can thereby be displaced in the axial direction of the housing 23 inside a cylinder wall 30. On one end, the housing 23 can be closed by an end-cap or first end-cap 10 or an end-cap 110 (see FIG. 3) in the vicinity of the piston 1, and on the other end, after a compression spring 6 has preferably been inserted, the entire housing 23 can be closed with an end cap 24 and a spring abutment 25, which spring abutment 25 can be attached to the end-cap 24.

Figure 3:
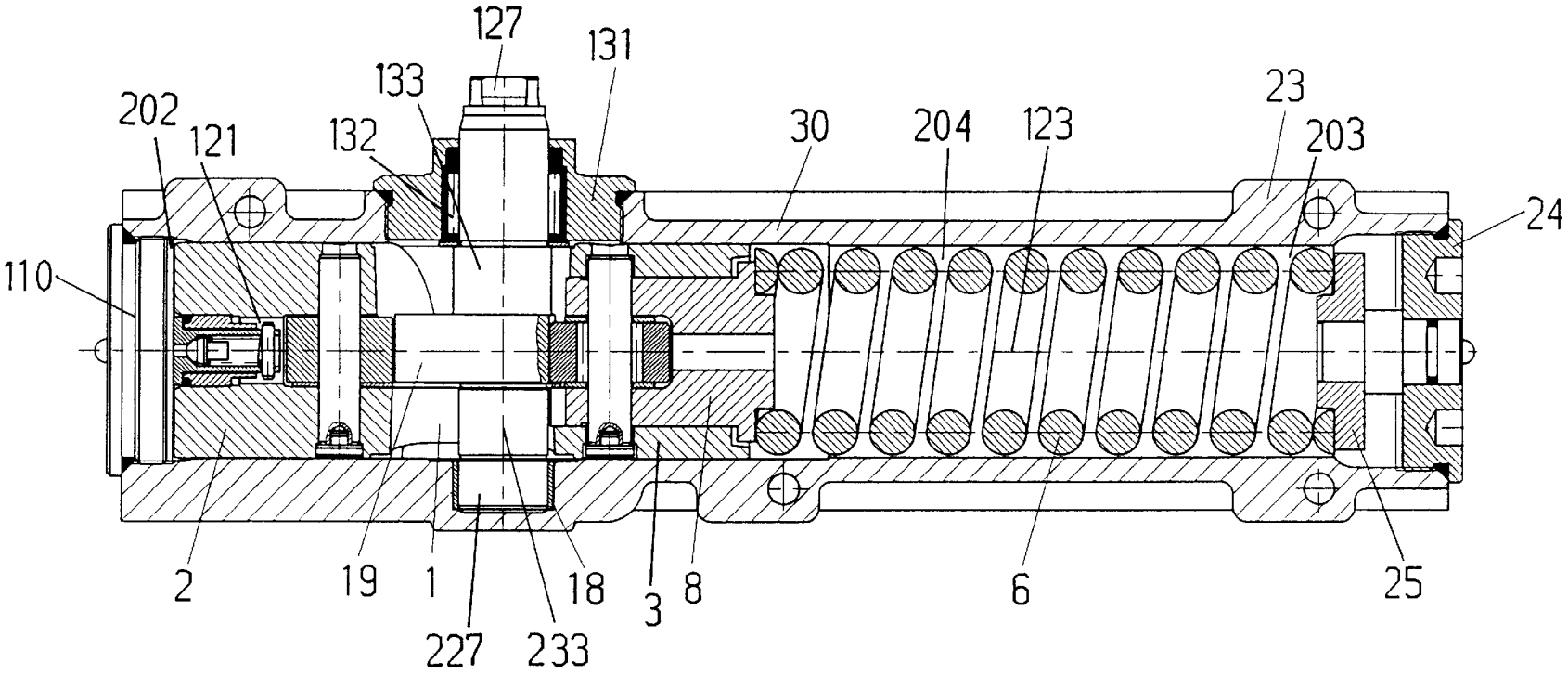
FIG. 3 shows another embodiment of a top-mounted door closer in a section view, with the piston inserted.

In other words, FIG. 3 illustrates a possible embodiment of a door closer in accordance with the present invention. The door closer can include the housing 23. The housing 23 can have a longitudinal axis 123, which longitudinal axis 123 can define an axial direction substantially parallel with the longitudinal axis 123. The door closer can include a closer shaft 133, which closer shaft 133 can be located at least partially within the housing 23. The closer shaft 133 can be oriented substantially transverse to the longitudinal axis 123. An end 127 of the closer shaft 133 can extend outwardly from the housing 23; the closer shaft end 127 can be configured to be attached or connected to an actuator arm (not shown). The actuator arm can preferably be attached to a door or door frame (not shown). The end 127 can extend through an end-cap 131 attached to the housing 23. Inside the end-cap 131 can be a bearing 132 to rotatably support the end 127 of the closer shaft 133. An opposite end 227 of the closer shaft 133 can be rotatably supported within the housing 23 by the bearing 18 to preferably rotate about a shaft axis of rotation 233.

The closer shaft 133 can extend through the eccentric cam plate 19. The closer shaft 133 and the eccentric cam plate 19 can be non-rotatably connected to one another so that rotation of one of the eccentric cam plate 19 and the closer shaft 133 substantially about the axis of rotation 233 can cause rotation of the other of the eccentric cam plate 19 and the closer shaft 133 about the axis of rotation 233. The eccentric cam plate 19 can be preferably positioned substantially along the longitudinal axis 123 of the housing 23.

The eccentric cam plate 19 can be used to both convert the rotation of the closer shaft 133 to axial translation or axial motion of the piston 1, and to convert the axial translation of the piston 1 to rotation of the closer shaft 133 during an opening and closing of the door. During the opening of the door, the actuator arm can cause rotation of the closer shaft 133 in a first or opening direction of rotation. The rotation of the closer shaft 133 in this opening direction of rotation can cause the piston 1 to move axially in a first, or opening direction. An energy absorbing apparatus, preferably including the compression spring 6, can store energy during the opening of the door so as to supply energy for the subsequent closing of the door. During an opening of the door, the piston 1 can move to the right as shown in FIG. 3, thereby compressing the spring 6 between the piston 1 and the spring abutment 25 to store energy within the spring 6 to subsequently close the door.

Once the door is released after opening, the spring 6 can exert an axial force on the piston 1 to move the piston 1 in an opposite second, or closing direction of travel. The motion of the piston 1 in this closing direction of travel can cause the closer shaft 133 to rotate in an opposite second, or closing, direction of rotation to preferably cause the actuator arm to return the door to the closed position. During the closing of the door, the piston 1 can move to the left as shown in FIG. 3; the spring 6 can extend to release the stored energy obtained during the opening of the door. The spring can exert a force on the piston 1 to move the piston 1 in the closing direction to thereby close the door.

Figure 2:
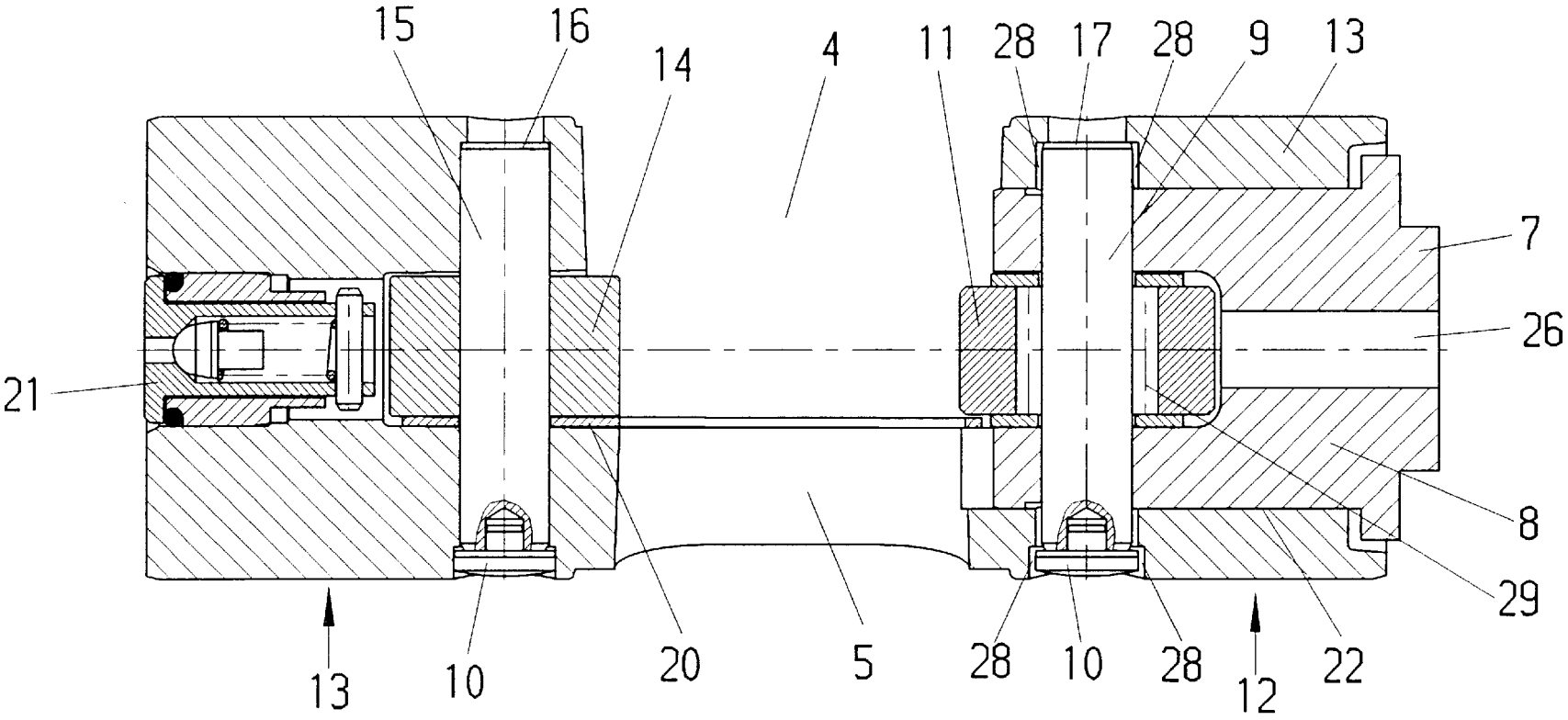
FIG. 2 shows a detail of the piston shown in FIG. 1 in a sectional view in the axial direction.

As shown in FIG. 1, the piston 1 can be inserted in the form of a single assembly inside the housing 23. The piston 1 can be realized as a one-piece part, and the piston 1 can contain both a damping piston 2 and a spring assist element 3. In the embodiment shown in FIG. 1, the piston 1 can have a radially worked recess 4 (see FIG. 2) approximately in a central portion of the piston 1, which recess 4 can extend beyond the axial center. In the remaining adjacent portion, namely the connection 105 (see FIG. 4) between the damping piston part 2 and the spring assist element part 3, there can be an opening or recess 5 (see FIG. 2), which opening 5 can make it possible to extend closer shaft 33 practically all the way through the piston 1. The recess 5 can preferably thereby be not realized in the form of a circular boring or bore, but the recess 5 can be realized preferably in the form of a slot, to allow the piston 1 to move axially.

In other words, as shown in FIG. 3 for a possible embodiment, the piston 1 can divide the housing 23 into two chamber portions: a left chamber portion 202 located between the piston 1 and the end-cap 110, and a right chamber portion 203 located between the piston 1 and the end-cap 24. The spring 6 can preferably be located within the right chamber portion 203. The piston 1 therefore can have two preferably integral parts or unitary portions 2 and 3: portion 2 or damping piston 2 adjacent the left chamber portion 202, and portion 3 or spring assist element 3 adjacent the right chamber portion 203. A longitudinal axis or preferably centerline 101 (see FIG. 4) of the piston 1 can be substantially coaxial with the longitudinal axis 123 of the housing 23.

Connecting the two portions 2 and 3 of the piston 1 (that is, connecting the damping piston 2 and the spring assist element 3 of the piston 1) with one another can be a third portion 105 or connection portion 105 of the piston 1. The connection portion 105 can have the recess or slot or bore or passage 5, which recess 5 can be configured so as to allow the closer shaft 133 to extend therethrough. Because the piston 1 preferably moves axially during operation of the door closer, the recess 5 can be formed as a slot, which slot 5 can preferably have a sufficient axial width to permit the desired axial movement of the piston 1 during operation of the door closer without interference from the closer shaft 133.

First, let us consider the part of the piston 1 which part or portion preferably functions as the damping piston 2. In the axial direction, inside the damping piston 2 there can be a boring or passage 121 (see FIG. 4), in which boring 121 a non-return and pressure relief valve 21 (see FIG. 2) can be installed. This non-return and pressure relief valve 21 can be necessary, in possible embodiments, for the correct or preferably functioning of the top-mounted door closer. Toward the vicinity of the recess 4, the damping piston 2 can have a radial boring or bore 16, which boring 16 is preferably realized in the form of a blind hole 16 or, in other possible embodiments of the present invention, the boring 16 can be realized in the form of a stepped or graduated boring. Inside the boring 16, a pin 15 can be installed positively and non-positively, and the pin 15 can simultaneously hold the starting roller 14. The starting roller 14 can be rotationally mounted in a recess 114 (see FIG. 4). The pin 15, at its end which points toward the cylinder wall 30, can be protected against slipping out by a second end cap or an end cap 10 or an end cap 210 (see FIG. 4), which end cap 10 can preferably be made of plastic. This arrangement can simultaneously prevent the occurrence of chatter marks inside the cylinder wall 30.

Let us now consider the part of the piston 1 which acts as the spring assist element 3. The spring assist element 3 can be provided in its inner area with a boring or bore 22 (see FIG. 2) or hole or bore 103 (see FIG. 4) into which boring 22 an inner part 8 can be inserted preferably lengthwise so that the inner part 8 can be displaced in the axial direction. This inner part 8 can act as a contact for the compression spring 6. For this purpose, on the inner part 8 there preferably is an extension 7, which extension 7 can substantially prevent or limit the compression spring 6 from being displaced out of the axial position. Inside the inner part 8 there can be a bore or boring 26, which boring 26 can be preferably located approximately in the center of the inner part 8. The boring 26 can allow damping medium 204 (see FIG. 3) to flow from the unpressurized chamber to the compression chamber and vice-versa.

In the spring assist element 3 there can also be a roller 11, which roller 11 can act as a force transmission roller 11. The force transmission roller 11 can be inserted differently from the pin 15 in the damping piston 2. The force transmission roller 11 can have a needle bearing 29, whereby a pin 9 extends through the boring in the needle bearing 29. At the same time, this pin 9 can be held radially in a bore or boring 109 (see FIG. 4) inside the inner part 8 by preferably an interference fit. But the pin 9 is preferably longer than the diameter of the inner part 8, and therefore the pin 9 can project with its ends in areas 12, 13 of the outer wall of the spring assist element 3. For this purpose, there are borings 28 in the spring assist element 3, which borings 28, however, have a clearance so that when the pin 9 is inserted, the inner part 8 can preferably move by a specified distance in the axial direction. The area of the spring assist element 3 thereby can have a blind hole or a stepped hole 17, and the pin 9, on its other end, also can have a third end cap or an end cap 10 or an end cap 310 (see FIG. 4), which end cap 10 can substantially prevent or limit the pin 9 from coming into contact with the cylinder wall 30.

In other words, as shown in FIG. 3, axial motion of the piston 1 can cause a change in volume of each of the left chamber portion 202 and the right chamber portion 203. For example, axial motion of the piston 1 in an opening movement of a door (that is, axial movement of the piston 1 to the right as shown in FIG. 3) can cause the volume of the left chamber portion 202 to increase and the volume of the right chamber portion 203 to decrease. Similarly, axial motion of the piston 1 in a closing movement of a door (that is, axial movement of the piston 1 to the left as shown in FIG. 3) can cause the volume of the left chamber portion 202 to decrease and the volume of the right chamber portion 203 to increase. Because the damping piston portion 2 and the spring assist element 3 are preferably integral portions and/or unitary portions of the piston 1, axial motion of the piston 1 can, in essence, assure substantially simultaneous changes in volume of the left chamber portion 202 and the right chamber portion 203.

Because essentially simultaneous expansion and contractions of the volumes of the left and right chamber portions 202 and 203 can be assured by the use of the piston 1, the door closer made in accordance with the present invention can have an increased efficiency as compared to known door closers. Also, by having the damping piston portion 2 and the spring assist element 3 being an integral or unitary portion of the piston 1, the longer axial dimension of the piston 1 in comparison to the individual axial dimensions of the portions 2 and 3 can permit the piston 1 to be better guided in its (the piston 1) axial motion by the walls 30 of the housing 23 as compared to the use of a separate, non-integral damping piston 2 and spring assist element 3 in the known door closers described earlier. This feature can also increase the efficiency of the door closer made in accordance with the present invention as compared to the known door closers.

To further increase efficiency, in possible embodiments of the present invention some limited axial play or movement or displacement of the roller 11 with respect to the roller 14 can be provided. The axial play between the rollers 11 and 14 can allow the axial distance between the rollers 11 and 14 to vary during axial movement of the piston 1 and rotation of the eccentric cam plate 9. Essentially permanent contact of each of the rollers 11 and 14 with the eccentric cam plate 9 can therefore be substantially assured throughout the operation of the door closer (to compensate for manufacturing tolerances of the eccentric cam plate 9, for example). By essentially assuring contact of the rollers 11 and 14 with the eccentric cam plate 9, the forces transferred between the piston 1 and the eccentric cam plate 9 preferably can act substantially parallel with and substantially along the longitudinal axis or preferably centerline 123 of the door closer to essentially eliminate or limit the tendency of the piston 1 to be effected by transverse forces or tipping moments during operation of the door closer.

Figure 4:
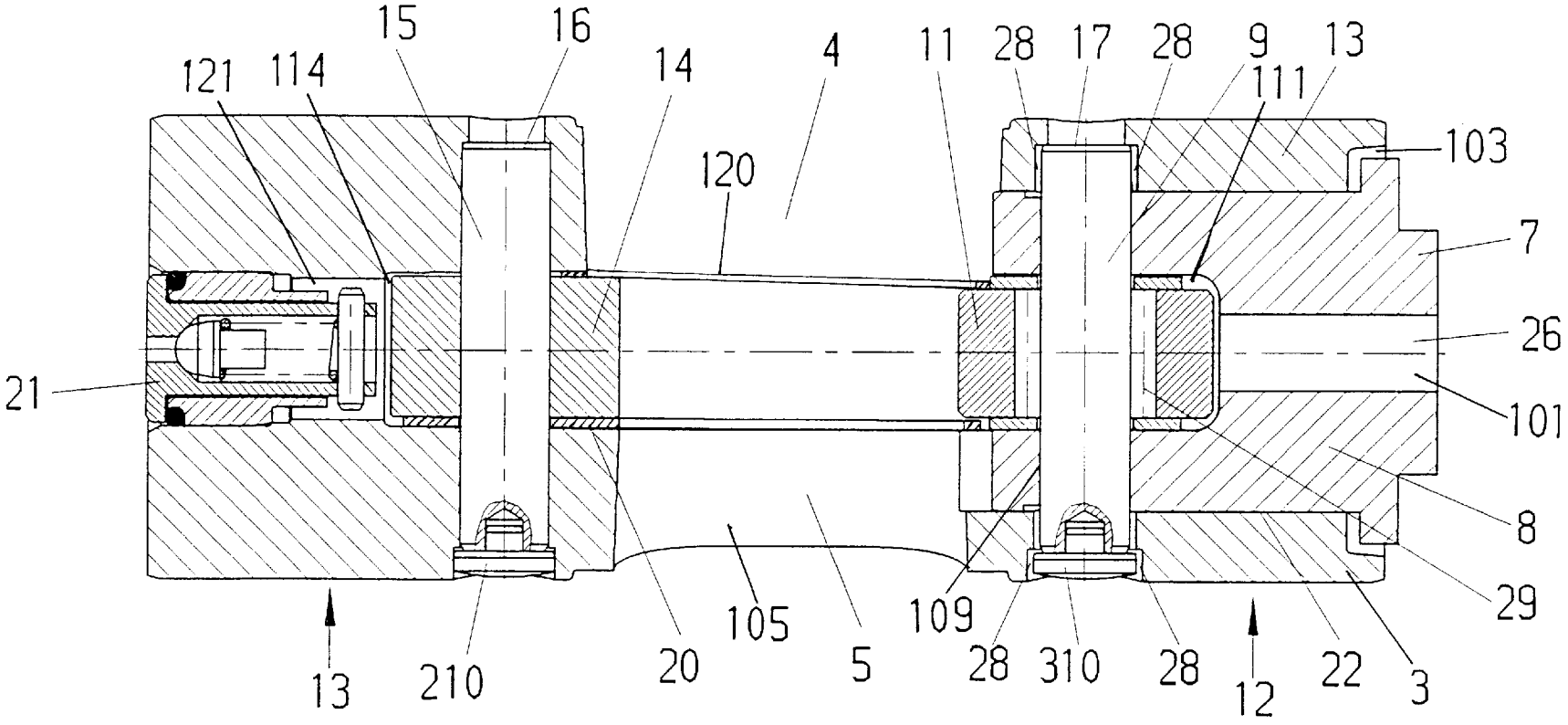
FIG. 4 shows a detail of the piston shown in FIG. 3 in a sectional view in the axial direction.

As shown in FIG. 4, for a possible embodiment, the roller 11 mounted on the pin 9 can be located at least partially within a recess 111 preferably formed in the inner part 8. Axial clearance between the pin 9 and the spring assist element 3 can be provided by the borings 28 to permit limited axial play of the roller 11 with respect to the piston 1. Because the roller 14 can be preferably mounted substantially axially fixed with respect to the piston 1, limited axial play between the rollers 11 and 14 can result during operation of the door closer.

Because the piston 1 and the inner part 8 can be separate components, the inner part 8 can be made from the same material as the piston 1, or the inner part 8 can be made from a different material from the piston 1. The piston 1 can be made from a relatively light metal alloy, i.e. for a possible embodiment, a metal alloy less dense than steel (for example, aluminum). The piston 1 can be a cast part. In one possible embodiment of the present invention, the piston 1 can be aluminum and the inner part 8 can be steel. In another possible embodiment, the inner part 8 can be aluminum or other relatively light metal alloy. In yet another possible embodiment, the inner part 8 can be plastic.

To dampen movement of the door attached to the door closer, damping medium or damping fluid 204 can be contained within each of the left and right chamber portions 202 and 203. A flow connection can fluidly connect the left and right chamber portions 202 and 203, thereby permitting flow of damping medium 204 between the left and right chamber portions 202 and 203 during an opening and closing movement of a door. As shown in FIGS. 3 and 4, for a possible embodiment of the flow connection, the left and right chamber portions 202 and 203 can be fluidly connected via the channel or boring 26, the recess 111, the recess 4, the recess 114 and the channel or boring 121. To regulate the damping force, the one-way valve 21 can be located preferably within the boring 121. The one-way valve 21 can restrict or obstruct the flow of damping medium 204 in one direction of flow, and can be less restrictive or obstructive to the flow of damping medium 204 in the opposite direction of flow. The one-way valve 21 can permit the damping force or resistive force generated by the axial motion of the piston 1 to be substantially different for an opening movement of a door as compared to the damping force or resistive force generated during a closing movement of a door.

To prevent any unintentional rotation of the piston 1 with respect to the eccentric cam plate 19, there can be a safety plate 20, which safety plate 20 can simultaneously be held in its position by the pins 9, 15. The safety plate 20 can thereby be inserted both below and above the starting roller 14 and the force transmission roller 11. The safety plate 20 thereby preferably has in its central area an opening, which opening can be approximately identical to the opening 5 which is in the piston 1. The safety plate 20 can essentially guarantee the prevention of any rotation of the piston 1 with respect to the axial or radial plane of the closer shaft 33.

In other words, for a possible embodiment of the present invention, the safety plate 20 can limit or prevent rotation of the piston 1 with respect to the axial or radial plane of the closer shaft 33 or with respect to the longitudinal axis 123 of the door closer. The safety plate 20 can be shaped to permit flow of the damping medium 204 between the chamber portions 202 and 203. In a possible variable embodiment of the present invention, a second safety plate 120 (see FIG. 4) can also be used, preferably located on the opposite side of the rollers 11 and 14 from the safety plate 20 as shown in FIGS. 3 and 4.

One feature of the invention resides broadly in the top-mounted or overhead door closer with a closer shaft which can be actuated by a spring system in the closing direction, and a damping piston which is effectively connected to the closer shaft, whereby the end of the closer shaft which projects out of the housing is coupled and connected to an actuator arm in the form of a slide rail linkage, which guide arm or actuator arm is engaged in a guide rail by means of a slide which is located on the other end, whereby the closer shaft has an eccentric cam plate, the cam profile of which corresponding to the opening direction is pressurized by a spring assist element by means of at least one roller, and the cam profile of which corresponding to the closing direction is pressurized by a damping piston by means of an additional roller, 60 that the roller of the damping piston and the roller of the spring assist element are oriented coaxially with the closer shaft, characterized by the fact that a one-piece piston 1 is used which combines the functions of a damping piston 2 and a spring assist element 3.

Another feature of the invention resides broadly in the top-mounted door closer characterized by the fact that the piston 1 has an opening 5 and a recess 4 in its central area.

Yet another feature of the invention resides broadly in the top-mounted door closer characterized by the fact that in the vicinity of the spring assist element 3, the piston 1 has a boring 22 in the axial direction, into which boring is inserted an inner part 8 with an extension for the compression spring 6.

Still another feature of the invention resides broadly in the top-mounted door closer characterized by the fact that in the inner part 8, a force transmission roller 11 is rotationally mounted by means of a pin 9 which is inserted radially.

A further feature of the invention resides broadly in the top-mounted door closer characterized by the fact that the pin 9 is retained in the inner part 8 by an interference fit, and projects into the areas 12, 13 of the spring assist element and has a clearance 28 with respect to this boring 17.

Another feature of the invention resides broadly in the top-mounted door closer characterized by the fact that a starting roller 14 is rotationally mounted in the damping piston 2 by means of a radially inserted pin 15.

Yet another feature of the invention resides broadly in the top-mounted door closer characterized by the fact that the pins 9, 15 project into blind holes or graduated holes 16, 17, and the ends of the pins 9, 15 which point toward the outside wall of the piston 1 are covered by end caps 10.

Still another feature of the invention resides broadly in the top-mounted door closer characterized by the fact that the piston 1 is located so that it does not rotate with respect to the eccentric cam plate 19.

A further feature of the invention resides broadly in the top-mounted door closer characterized by the fact that a safety plate 20 is installed below and above the eccentric cam plate 10 to prevent rotation.

Another feature of the invention resides broadly in the top-mounted door closer characterized by the fact that there is a non-return and pressure relief valve 21 in the damping piston 2.

Yet another feature of the invention resides broadly in the top-mounted door closer characterized by the fact that the piston 1 is made of light alloy metal.

Still another feature of the invention resides broadly in the top-mounted door closer characterized by the fact that the piston 1 is a cast part.

A further feature of the invention resides broadly in the top-mounted door closer characterized by the fact that the inner part 8 is made of steel.

Another feature of the invention resides broadly in the top-mounted door closer characterized by the fact that the inner part 8 is made of plastic.

Yet another feature of the invention resides broadly in the top-mounted door closer characterized by the fact that the the inner part 8 is made of aluminum.

Examples of door closers that could be adapted for use in the context of the present invention and include components that could be adapted for use in embodiments of the present invention could be disclosed by the following U.S. Patents and U.S. Patent Applications, each of which are assigned to the assignee of the present invention: U.S. Pat. No. 5,461,754, U.S. Pat. No. 5,311,642, Ser. No. 08/735970, Ser. No. 08/735414, Ser. No. 08/733226, and Ser. No. 08/664401.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 196 03 186.9, filed on Jan. 30, 1996, and PCT/DE97/00122, filed on Jan. 24, 1997, having inventor Dietrich Jentsch, and DE-OS 196 03 186.9 and PCT/DE97/00122 and DE-PS 196 03 186.9 and PCT/DE97/00122, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An overhead door closer for at least closing a door, said overhead door closer comprising:

a housing having a longitudinal axis;

said housing comprising a chamber disposed within said housing;

said chamber being configured to contain a fluid;

a piston;

said piston being configured and disposed to move axially in said housing;

said piston being disposed in said housing to divide said chamber into a first chamber and a second chamber;

said piston comprising an arrangement to permit passage of fluid between said first chamber and said second chamber;

said piston comprising a first end and a second end;

said first end of said piston being disposed opposite said second end of said piston;

said piston comprising a single, one-piece, integral, unitary structure;

said single, one-piece, integral, unitary structure comprising a first portion and a second portion;

said first portion of said single, one-piece, integral, unitary structure being disposed at said first end of said piston;

said first portion of said single, one-piece, integral, unitary structure being disposed adjacent to said first chamber;

said second portion of said single, one-piece, integral, unitary structure being disposed at said second end of said piston;

said second portion of said single, one-piece, integral, unitary structure being disposed adjacent to said second chamber;

a spring arrangement;

said spring arrangement being disposed in said second chamber;

said spring arrangement being disposed to provide a force upon said second portion of said single, one-piece, integral, unitary structure;

a shaft;

said shaft having a rotational axis substantially transverse to the longitudinal axis;

said shaft being configured and disposed to be operatively connected to said single, one-piece, integral, unitary structure, said single, one-piece, integral, unitary structure comprising a third portion, said third portion being disposed between said first portion and said second portion;

said third portion being configured and disposed to receive said shaft;

said shaft being disposed between said first portion of said single, one-piece, integral, unitary structure and said second portion of said single, one-piece, integral, unitary structure;

said shaft being configured to rotate in a first direction upon opening a door;

said shaft being configured to rotate in a second direction upon closing a door;

said shaft comprising a cam arrangement;

said cam arrangement being configured and disposed to move said single, one-piece, integral, unitary structure axially in said housing upon rotation of said shaft in the first direction;

said first end of said piston comprising a first roller;

said first roller being configured and disposed to contact said cam arrangement upon said rotation of said shaft in the second direction;

said first roller being operatively connected to said first portion of said single, one-piece, integral, unitary structure to move with said single, one-piece, integral, unitary structure;

said first roller having a rotational axis;

the rotational axis of said first roller being substantially transverse to the longitudinal axis;

the rotational axis of said first roller being substantially parallel to the rotational axis of said shaft;

said second end of said piston comprising at least one second roller;

said at least one second roller being configured and disposed to contact said cam arrangement upon rotation of said shaft in the first direction;

said at least one second roller being operatively connected to said second portion of said single, one-piece, integral, unitary structure to move with said single, one-piece, integral, unitary structure;

said at least one second roller having a rotational axis;

the rotational axis of said at least one second roller being substantially transverse to the longitudinal axis;

the rotational axis of said at least one second roller being substantially parallel to the rotational axis of said shaft;

said spring arrangement being configured to move said single, one-piece, integral, unitary structure and rotate said shaft in the second direction to close a door;

at least a portion of said shaft extending from said housing;

an arm to connect said shaft to a door;

said arm comprising a first end and a second end;

said second end of said arm being disposed opposite to said first end of said arm;

said first end of said arm being connected to said at least a portion of said shaft; and said second end of said arm comprising a slide mechanism to be disposed in a guide rail of a door.

2. The overhead door closer according to claim 1, wherein:

said third portion of said single, one-piece, integral, unitary structure comprises a recess; and said recess is configured and disposed to receive both said shaft and said cam arrangement.

3. The overhead door closer according to claim 2, wherein:

said second portion of said single, one-piece, integral, unitary structure comprises a boring;

said boring is disposed about the longitudinal axis;

said boring is disposed adjacent to said spring arrangement;

said second end of said piston comprises a member;

said member is disposed in said boring; and said at least one second roller is disposed in said member.

4. The overhead door closer according to claim 3, wherein:

said second end of said piston comprises a pin;

at least a portion of said pin is disposed in said member; and said pin is configured and disposed to rotationally mount said at least one second roller in said member.

5. The overhead door closer according to claim 4, wherein:

said at least a portion of said pin comprises a portion of said pin;

said portion of said pin is configured and disposed to be frictionally held in said member by an interference fit;

said boring is a first boring;

said second portion of said single, one-piece, integral, unitary structure comprises a second boring;

said pin is configured and disposed to extend from said member into said second boring; and said second boring is configured and disposed to provide a clearance between said second boring and said pin.

6. The overhead door closer according to claim 5, wherein:

said first roller is disposed in said first portion of said single, one-piece, integral, unitary structure;

said pin is a first pin;

said first end of said piston comprises a second pin;

said second pin is disposed in said first portion of said single, one-piece, integral, unitary structure; and said second pin is configured and disposed to rotationally mount said first roller in said first portion of said single, one-piece, integral, unitary structure.

7. The overhead door closer according to claim 6, wherein:

said first portion of said single, one-piece, integral, unitary structure comprises a third boring;

said second pin is disposed in said third boring to mount said first roller in said first portion of said single, one-piece, integral, unitary structure;

said first pin and said second pin each having a first end and a second end; and at least one of said first end and said second end of each of said first pin and said second pin comprises an end cap.

8. The overhead door closer according to claim 7, wherein said single, one-piece, integral, unitary structure comprises means to prevent unintentional rotation with respect to said cam arrangement.

9. The overhead door closer according to claim 8, wherein:

said means to prevent unintentional rotation comprises at least one plate;

said at least one plate is disposed at least one of above and below said cam arrangement; and said at least one plate is configured and disposed to limit rotation of said single, one-piece, integral, unitary structure with respect to said cam arrangement.

10. The overhead door closer according to claim 9, wherein:

said arrangement to permit passage of fluid comprises a non-return pressure relief valve; and said non-return pressure relief valve is disposed in said first portion of said single, one-piece, integral, unitary structure.

11. The overhead door closer according to claim 10, wherein:

said single, one-piece, integral, unitary structure comprises a light alloy metal;

said single, one-piece, integral, unitary structure is a cast part;

said member comprises one of steel, plastic and aluminum;

said cam arrangement is non-rotatably connected to said shaft;

said cam arrangement is disposed along the longitudinal axis;

said housing comprises a first end and a second end;

said first end of said housing is disposed adjacent to said first chamber;

said second end of said housing is disposed adjacent to said second chamber;

said first end of said housing comprises a first cap to seal said first end of said housing;

said second end of said housing comprises a second cap to seal said second end of said housing;

said housing comprises an opening;

said opening of said housing is configured and disposed to permit said at least a portion of said shaft to extend from said housing;

said overhead door closer comprises a third cap to seal said opening of housing;

said first roller is disposed along the longitudinal axis;

said first roller comprises a first bearing to mount said first roller on said second pin;

said at least one second roller is disposed along the longitudinal axis;

said at least one second roller comprises a second bearing to mount said at least one second roller on said first pin;

said shaft comprises a first end and a second end;

said first end of said shaft is disposed opposite to said second end of said shaft;

said second end of said shaft is disposed adjacent to said at least a portion of said shaft;

said piston comprises a third bearing to guide said first end of said shaft;

said third cap comprises a fourth bearing to guide said second end of said shaft;

said spring arrangement comprises a compression spring;

said member comprises an extension; and said extension of said member is configured and disposed to permit mounting of said compression spring with respect to said member.

12. A door closer comprising:

a housing having a longitudinal axis;

said housing comprising a chamber disposed within said housing;

said chamber being configured to contain a fluid;

a piston;

said piston being configured and disposed to move axially in said housing;

said piston being disposed in said housing to divide said chamber into a first chamber and a second chamber;

an arrangement to permit passage of fluid between said first chamber and said second chamber;

said piston comprising a first end and a second end;

said first end of said piston being disposed opposite said second end of said piston;

said piston comprising a single, one-piece, integral, unitary structure;

said single, one-piece, integral, unitary structure comprising a first portion and a second portion;

said first portion of said single, one-piece, integral, unitary structure being disposed in said first end of said piston;

said first portion of said single, one-piece, integral, unitary structure being disposed adjacent to said first chamber;

said second portion of said single, one-piece, integral, unitary structure being disposed in said second end of said piston;

said second portion of said single, one-piece, integral, unitary structure being disposed adjacent to said second chamber;

a spring arrangement;

said spring arrangement being disposed in said second chamber;

said spring arrangement being disposed to provide a force upon said second portion of said single, one-piece, integral, unitary structure;

a shaft to provide for opening and closing a door;

said shaft being configured and disposed to be operatively connected to said single, one-piece, integral, unitary structure;

said single, one-piece, integral, unitary structure comprising a third portion, said third portion being disposed between said first portion and said second portion;

said third portion being configured and disposed to receive said shaft;

said shaft being disposed between said first portion of said single, one-piece, integral, unitary structure and said second portion of said single, one-piece, integral, unitary structure;

said shaft comprising a cam arrangement;

said cam arrangement being configured and disposed to move said single, one-piece, integral, unitary structure axially in said housing upon rotation of said shaft;

a first structure being connected to said first portion of said single, one-piece, integral, unitary structure;

said first structure being configured and disposed to contact said cam arrangement;

a second structure being connected to said second portion of said single, one-piece, integral, unitary structure;

said second structure being configured and disposed to contact said cam arrangement;

said spring arrangement being configured and disposed to move said single, one-piece, integral, unitary structure and to rotate said shaft;

at least a portion of said shaft extending from said housing; and structure to connect said at least extending portion of said shaft to a door.

13. The door closer according to claim 12, wherein:

said third portion of said single, one-piece, integral, unitary structure comprises a recess; and said recess is configured and disposed to receive said shaft and said cam arrangement.

14. The overhead door closer according to claim 13, wherein said single, one-piece, integral, unitary structure comprises means to prevent unintentional rotation with respect to said cam arrangement.

15. The door closer according to claim 14, wherein:

said means to prevent unintentional rotation comprises at least one plate;

said at least one plate is disposed at least one of above and below said cam arrangement; and said at least one plate is configured and disposed to limit rotation of said single, one-piece, integral, unitary structure with respect to said cam arrangement.

16. The door closer according to claim 15, wherein:

said second portion of said single, one-piece, integral, unitary structure comprises a boring;

said boring is disposed about the longitudinal axis;

said boring is disposed adjacent to said spring arrangement;

said second end of said piston comprises a member;

said member is disposed in said boring;

said spring arrangement comprises a compression spring;

said member comprises an extension; and said extension of said member is configured and disposed to permit mounting of said compression spring on said member.

17. The door closer according to claim 16, wherein:

said second structure is disposed in said member;

said arrangement to permit passage of fluid comprises a non-return and pressure relief valve;

said non-return and pressure relief valve is disposed in said first portion of said single, one-piece, integral, unitary structure; and said cam arrangement is non-rotatably connected to said shaft.

18. The door closer according to claim 17, wherein:

said single, one-piece, integral, unitary structure comprises a light alloy metal;

said single, one-piece, integral, unitary structure is a cast part; and said member comprises one of steel, plastic and aluminum.

19. The door closer according to claim 18, wherein:

said shaft has a rotational axis substantially transverse to the longitudinal axis;

said first structure comprises a first roller;

said first roller is configured and disposed to contact said cam arrangement upon rotation of said shaft;

said first roller is disposed along the longitudinal axis;

said first roller has a rotational axis;

the rotational axis of said first roller is substantially transverse to the longitudinal axis;

the rotational axis of said first roller is substantially parallel to the rotational axis of said shaft;

said second structure comprises at least one second roller;

said at least one second roller is configured and disposed to contact said cam arrangement upon rotation of said shaft;

said at least one second roller is disposed along the longitudinal axis;

said at least one second roller has a rotational axis;

the rotational axis of said at least one second roller is substantially transverse to the longitudinal axis; and the rotational axis of said at least one second roller is substantially parallel to the rotational axis of said shaft.

20. The door closer according to claim 19, wherein:

said first roller is disposed in said first portion of said single, one-piece, integral, unitary structure;

said first end of said piston comprises a first pin;

said first pin is disposed in said first portion of said single, one-piece, integral, unitary structure;

said first pin is configured and disposed to rotationally mount said first roller in said first portion of said single, one-piece, integral, unitary structure;

said first roller comprises a first bearing to mount said first roller on said first pin;

said boring is a first boring;

said first portion of said single, one-piece, integral, unitary structure comprises a second boring;

said first pin is disposed in said second boring to mount said first roller in said first portion of said single, one-piece, integral, unitary structure;

said second end of said piston comprises a second pin;

at least a portion of said second pin is disposed in said member;

said second pin is configured and disposed to rotationally mount said at least one second roller in said member;

said at least a portion of said second pin is configured and disposed to be frictionally held in said member by an interference fit;

said second portion of said single, one-piece, integral, unitary structure comprises a third boring;

said second pin is configured and disposed to extend from said member into said third boring;

said third boring is configured to provide a clearance between said second boring and said second pin;

said at least one second roller comprises a second bearing to mount said at least one second roller on said second pin;

said first pin and said second pin each having a first end and a second end;

at least one of said first end and said second end of each of said first pin and said second pin comprises an end cap;

said cam arrangement is disposed along the longitudinal axis;

said housing comprises a first end and a second end;

said first end of said housing is disposed adjacent to said first chamber;

said second end of said housing is disposed adjacent to said second chamber;

said first end of said housing comprises a first cap to seal said first end of said housing;

said second end of said housing comprises a second cap to seal said second end of said housing;

said housing comprises an opening;

said opening of said housing is configured and disposed to permit said at least extending portion of said shaft to extend from said housing;

said door closer comprises a third cap to seal said opening of housing;

said shaft comprises a first end and a second end;

said second end of said shaft is disposed adjacent to said at least extending portion of said shaft;

said first end of said shaft is disposed opposite to said second end of said shaft;

said piston comprises a third bearing to guide said first end of said shaft; and said third cap comprises a fourth bearing to guide said second end of said shaft.

* * * * *

UNITED STATES PATENT AND TRADEMARK OFFICE

CERTIFICATE OF CORRECTION

PATENT NO. : 5,901,412

DATED : May 11, 1999

INVENTOR(S) : Dietrich JENTSCH

It is certified that error appears in the above-indentified patent and that said Letters Patent is hereby corrected as shown below:

In column 10, line 8, after 'roller,', delete "60" and insert --so--.

Signed and Sealed this

Eighth Day of February, 2000

*Attest:*

*Attesting Officer*

Q. TODD DICKINSON

*Commissioner of Patents and Trademarks*